US010646748B1

(12) United States Patent
Bernotas

(10) Patent No.: US 10,646,748 B1
(45) Date of Patent: May 12, 2020

(54) WRIST AND FOREARM EXERCISE AND REHABILITATION DEVICE

(71) Applicant: Philip Bernotas, Phoenixville, PA (US)

(72) Inventor: Philip Bernotas, Phoenixville, PA (US)

( * ) Notice: Subject to any disclaimer, the term of this patent is extended or adjusted under 35 U.S.C. 154(b) by 97 days.

(21) Appl. No.: 15/881,139

(22) Filed: Jan. 26, 2018

Related U.S. Application Data

(60) Provisional application No. 62/450,832, filed on Jan. 26, 2017.

(51) Int. Cl.

| | |
|---|---|
| ***A63B 23/14*** | (2006.01) |
| ***A61H 1/02*** | (2006.01) |
| ***A63B 21/00*** | (2006.01) |
| ***A63B 23/16*** | (2006.01) |

(52) U.S. Cl.
CPC ..... *A63B 23/14* (2013.01); *A61H 1/0274* (2013.01); *A63B 21/00069* (2013.01); *A63B 21/4049* (2015.10); *A63B 23/16* (2013.01); *A61H 2001/0203* (2013.01); *A61H 2201/1635* (2013.01); *A63B 21/4035* (2015.10)

(58) Field of Classification Search
CPC ... A63B 23/14; A63B 23/16; A63B 21/00069; A63B 21/4049; A63B 21/4035; A61H 1/0274; A61H 2201/1635; A61H 2001/0203
See application file for complete search history.

(56) References Cited

U.S. PATENT DOCUMENTS

| | | | | |
|---|---|---|---|---|
| 684,688 A | | 10/1901 | Herz | |
| 2,475,656 A | * | 7/1949 | Bidak | A63B 21/06 482/46 |
| 3,740,033 A | * | 6/1973 | Kamp | A63B 21/015 482/115 |
| 3,871,646 A | | 3/1975 | Slack | |
| 3,982,755 A | * | 9/1976 | Sarich | A63B 23/14 482/93 |
| 4,258,913 A | | 3/1981 | Brentham | |
| D264,237 S | * | 5/1982 | McCaleb | 482/46 |
| 4,438,920 A | * | 3/1984 | Veillette | A63B 23/14 482/46 |
| 4,455,019 A | | 6/1984 | Harris | |
| 4,570,925 A | | 2/1986 | Kock et al. | |
| 4,998,721 A | * | 3/1991 | Anders | A63B 21/0783 482/4 |
| 5,244,444 A | * | 9/1993 | Wostry | A63B 21/0615 482/109 |
| 5,312,309 A | * | 5/1994 | Fox | A63B 21/0004 482/120 |
| 5,514,052 A | | 5/1996 | Charles et al. | |
| 5,676,622 A | | 10/1997 | McFarlane | |

(Continued)

FOREIGN PATENT DOCUMENTS

| | | |
|---|---|---|
| FR | 659057 | 8/1928 |
| GB | 302467 | 12/1928 |

*Primary Examiner* — Garrett K Atkinson

(74) *Attorney, Agent, or Firm* — Joseph E. Maenner; Maenner & Associates, LLC

(57) ABSTRACT

A wrist and forearm exercise and rehabilitation device is disclosed. The device includes a base, a post extending vertically from the base, and a shaft rotatably inserted into the shaft. The shaft has a proximal end and a distal end. A biasing member has a first end attached to the shaft, such that rotation of the shaft exerts a force on the biasing member. A method of using the device is also disclosed.

12 Claims, 7 Drawing Sheets

(56) References Cited

U.S. PATENT DOCUMENTS 5,738,613 A 4/1998 Clayton
5,788,607 A 8/1998 Baker
5,871,423 A * 2/1999 Pruchnik ..... A63B 21/22 482/1
5,967,949 A * 10/1999 Davenport ..... A63B 21/153 482/108
6,099,437 A * 8/2000 DeMers ..... A63B 23/14 482/46
6,117,093 A * 9/2000 Carlson ..... A63B 21/0056 482/4
6,234,934 B1 * 5/2001 Gorczyca ..... A63B 21/0609 482/108
D505,459 S * 5/2005 Lagattuta ..... D21/680
7,028,682 B1 * 4/2006 Hansen ..... A63B 69/407 124/16
7,029,423 B2 * 4/2006 Lear, Jr. ..... A63B 21/06 482/40
7,351,186 B1 4/2008 Herman et al.
7,625,318 B1 12/2009 Heyn
7,753,827 B1 * 7/2010 Emick ..... A63B 21/00181 482/44
8,636,630 B2 * 1/2014 Morris ..... A63B 21/00069 482/117
8,915,828 B1 * 12/2014 Stalnaker ..... A63B 21/00185 482/117
9,028,378 B2 5/2015 Shah
9,522,294 B1 * 12/2016 Kangatharalingam ..... A63B 21/06
10,300,331 B2 * 5/2019 Seltzer ..... A63B 23/1281
10,384,096 B1 * 8/2019 Aery ..... A63B 21/0728
2006/0276315 A1 * 12/2006 Krietzman ..... A63B 21/005 482/114
2007/0254780 A1 11/2007 Findeisen
2010/0130330 A1 5/2010 McSorley
2011/0045953 A1 2/2011 Poli
2011/0071443 A1 3/2011 Weisz et al.
2011/0287907 A1 * 11/2011 Morris ..... A63B 21/00069 482/117
2018/0126205 A1 * 5/2018 Rogers ..... F16B 2/065
2018/0214740 A1 * 8/2018 Horen ..... A63B 23/12
2018/0361200 A1 * 12/2018 Walker ..... A63B 21/4047

* cited by examiner

WRIST AND FOREARM EXERCISE AND REHABILITATION DEVICE

CROSS-REFERENCE TO RELATED APPLICATION

The present application claims priority from U.S. Provisional Patent Application Ser. No. 62/450,832, filed on Jan. 26, 2017, which is incorporated herein by reference in its entirety.

BACKGROUND OF THE INVENTION

Physical therapy rehabilitation machines are used in physical therapy to help a patient to exercise a particular muscle or muscle group that is being rehabilitated. Typically, these machines narrowly focus on only a single muscle or muscle group.

It would be beneficial to provide a physical therapy rehabilitation training machine that can be used to exercise different muscles or muscle groups, particularly without having to reconfigure the machine.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In one embodiment, the present invention is a wrist and forearm exercise and rehabilitation device. The device includes a base, a post extending vertically from the base, and a shaft rotatably inserted into the shaft. The shaft has a proximal end and a distal end. A biasing member has a first end attached to the shaft and a second end attached to the base, such that rotation of the shaft extends the biasing member.

In another embodiment, the present invention is a method of using the device described above.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION OF THE INVENTION

Figure 1:
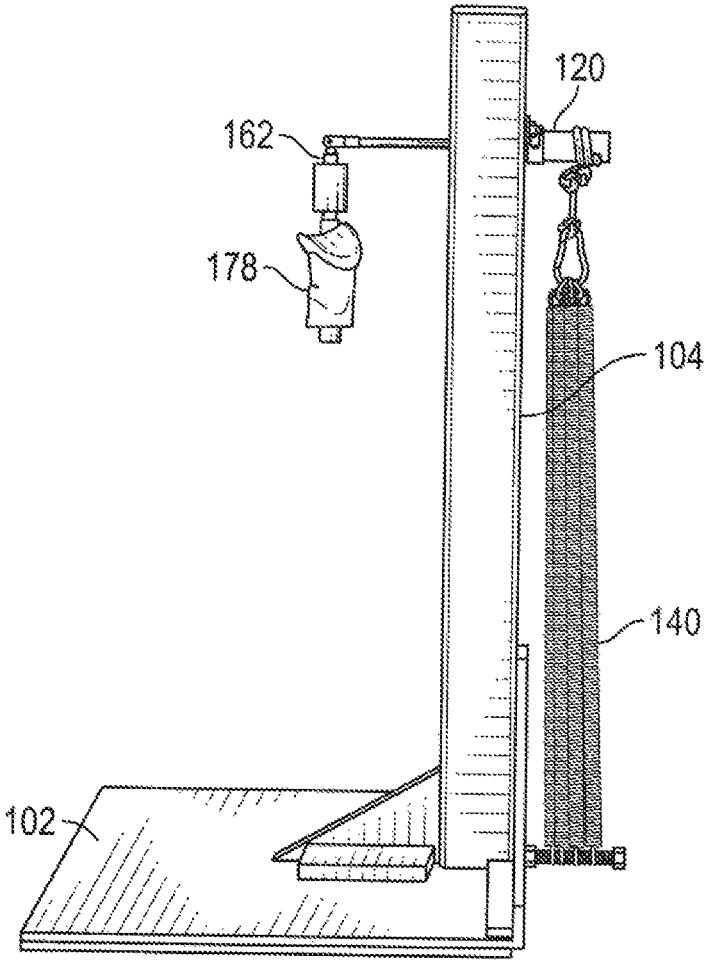
FIG. 1 is a side elevational view of a wrist and forearm exercise and rehabilitation device according to a first exemplary embodiment of the present invention.

In the drawings, like numerals indicate like elements throughout. Certain terminology is used herein for convenience only and is not to be taken as a limitation on the present invention. The terminology includes the words specifically mentioned, derivatives thereof and words of similar import. As used herein, the term "proximal" is intended to mean a direction closer to a user of the inventive device and the term "distal" is intended to mean a direction farther from the user of the inventive device.

The embodiments illustrated below are not intended to be exhaustive or to limit the invention to the precise form disclosed. These embodiments are chosen and described to best explain the principle of the invention and its application and practical use and to enable others skilled in the art to best utilize the invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

As used in this application, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

As shown in FIGS. 1-5, a first exemplary embodiment of the present invention is an exercise device ("device") 100 that can be used for rehabilitating and strengthening muscles in a hand, wrist and forearm. When operated in a first rotational direction, device 100 enables flexion and supination movements to be performed simultaneously. Conversely, when operated in a second, opposite, rotational direction, device 100 allows extension and pronation movements to be performed simultaneously. The forearm and upper arm muscles essentially link flexion with supination and extension with pronation.

When these linked movements are performed together, greater component torsion is possible, resulting in a more effective exercise. In addition to providing compound movements, device 100 provides resistance that approximates the strength curves for the flexion-supination as well as the extension-pronation. This increases the capability that, upon termination of the exercise, all of the muscles involved have been thoroughly worked throughout their range of motion.

Device 100 can be used by a patient while in a standing position. Alternatively, the height of device 100 can be adjusted to allow the patient to use device 100 while in a seated position.

Referring to FIGS. 1-5, device 100 includes a base 102 on which a patient stands during use of device 100. If the patient is seated, the patient's chair can be placed on base 102 to keep device 100 from moving along the floor while in use. Alternatively, if device 100 is to be permanently fixed in a location, base 102 can be fixedly attached to the floor, such as by bolts or other suitable securing device.

A support post 104 extends upwardly from base 102 at a distal end 106 of base 102. Optionally, support gussets 108, 110 can be provided at a juncture of base 102 and support post 104 to provide both lateral and longitudinal stability to support post 104 with respect to base 102.

Top end 112 of support post 104 includes a slot 114 extending therethrough from a distal side 116 to a proximal side 118. Slot 114 has a generally circular cross section and is used to rotatably support a shaft 120 inserted therethrough. Shaft 120 includes a distal end 122 that extends from distal side 116 of support post 104 and a proximal end 124 that extends from proximal side 118 of support post 104. Shaft 120 is axially rotatable and proximally/distally slidable within slot 114.

A biasing assembly 130 is attached to distal end 122 of shaft 120. Biasing assembly 130 includes a flexible member 132, such as a rope, a cable, or other suitable elongate flexible member, having a top end 133 connected to distal end 122 of shaft. Flexible member 132 has a lower end 134 that is connected to a top end 142 of a biasing member 140, such as a helical spring assembly 144 that is in a compressed condition in an unbiased state. A bottom end 146 of helical spring assembly 144 is fixed to a spring support 148 that extends distally from distal end 106 of base 102.

Figure 2:
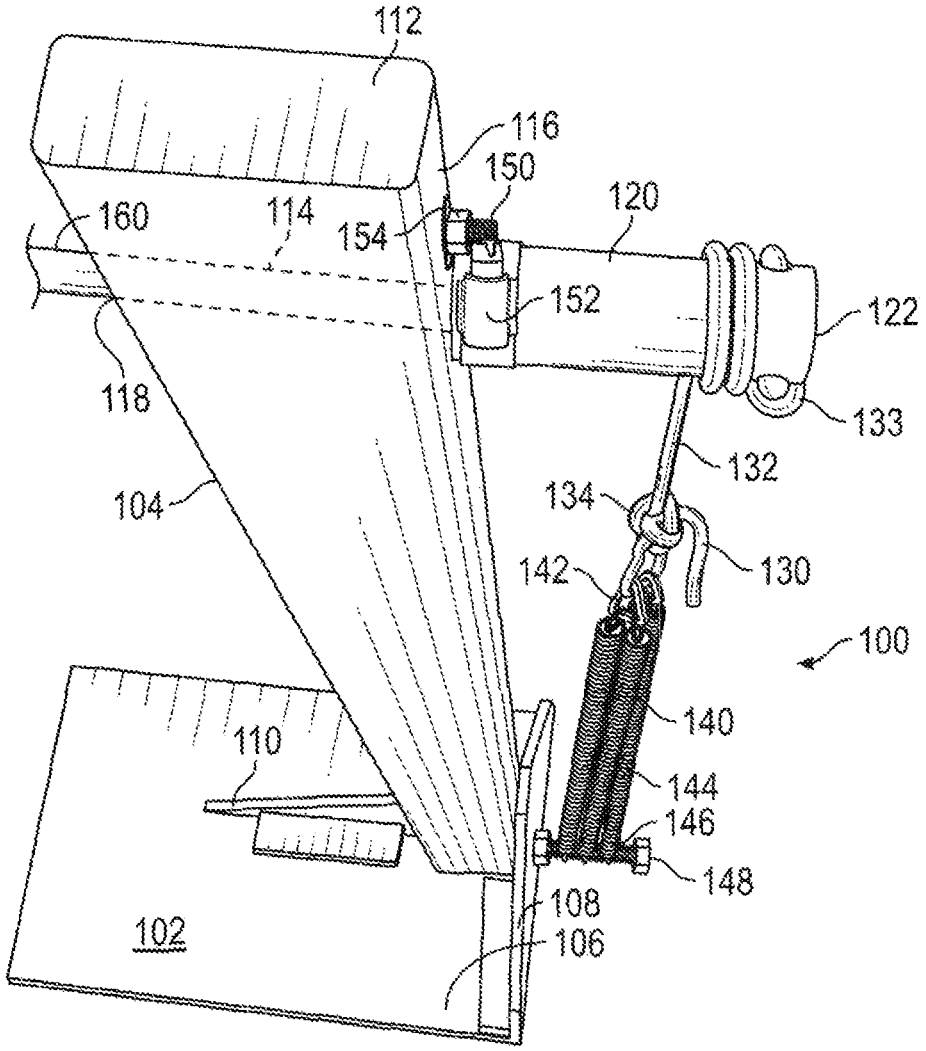
FIG. 2 is a perspective view of a distal end of the device shown in FIG. 1.

As shown in FIG. 2, more than one helical spring assembly 144 can be provided, depending on the desire range of force required to operate device 100. Further, those skilled in the art will recognize that different sizes of helical spring assembly 144 can be used to alter the amount of required force used to operated device 100.

Shaft 120 can have a predetermined diameter to relate a rotational angle of movement of shaft 120 with a desired amount of biasing exerted on helical sprig assembly 144. For example, for a larger diameter shaft, a larger force is applied to biasing assembly 130 to rotate shaft 120 a certain number of degrees than the force that needs to be applied to rotate shaft 120 the same amount of degrees with a smaller diameter of shaft 120.

Figure 3:
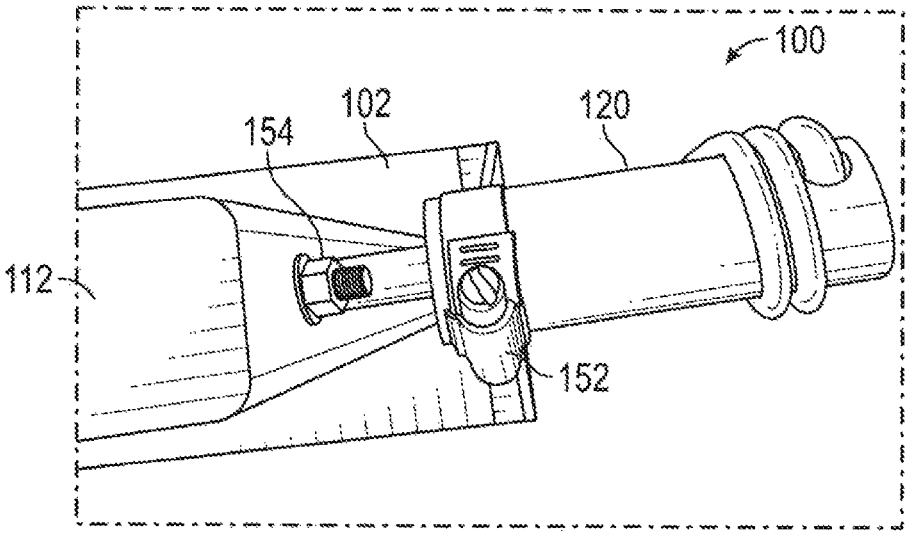
FIG. 3 is a top plan view of the distal end of the device shown in FIG. 1.

Shaft 120 can include a collar 150 fixedly attached thereto at distal side 116 of support post 104. A collar extension 152 extends radially outwardly from collar 150. Collar extension 152 restricts distal translation of shaft 150 in slot 114. A collar stop 154 is mounted on distal side 116 of support post 104 proximate to shaft 120 so that, when shaft 120 is slid proximally in slot 114 such that collar extension 152 engages or is proximate to support post 104, collar stop 154 restricts axial rotation of shaft 120 in slot 114. FIG. 2 shows shaft 120 slid proximally so that collar extension 152 engages collar stop 154, while FIG. 3 shows shaft 120 slid distally so that collar extension 152 does not engage collar stop 154.

While biasing assembly 130, collar extension 152, and collar stop 154 are shown as being located distal of support post 104, those skilled in the art will recognize that biasing assembly 130, collar extension 152, and collar stop 154 can alternatively be located proximate of support post 104.

Figure 4:
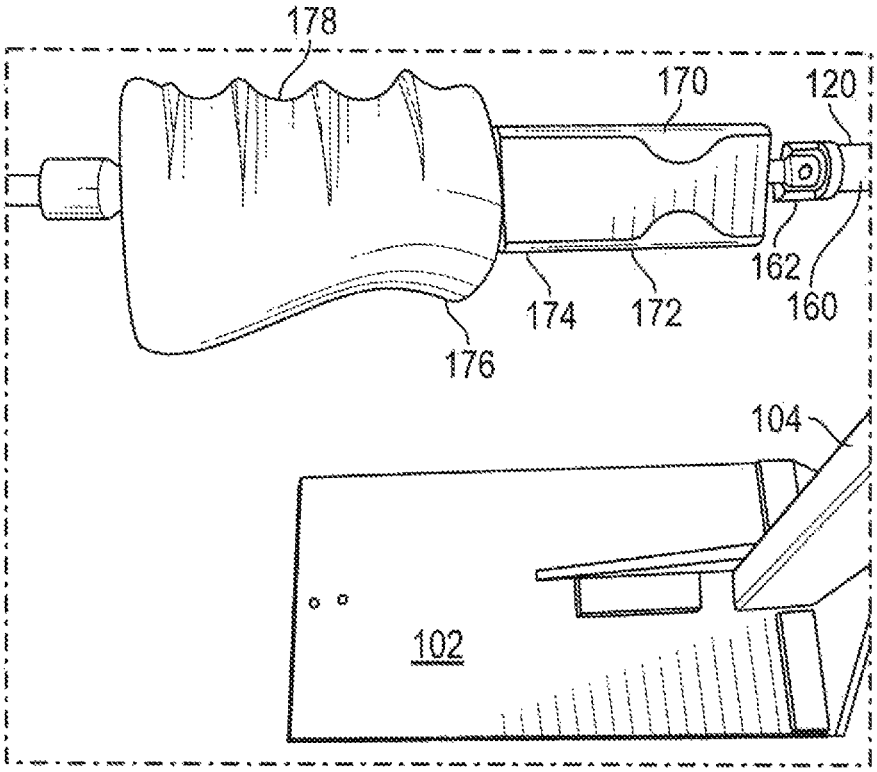
FIG. 4 is a top plan view of a proximal end of the device shown in FIG. 1.

Referring to FIG. 4, a proximal end 160 of shaft 120 extends proximally from support post 104. Proximal end 160 of shaft 120 ends in a universal joint 162. Universal joint 162 allows for infinite rotation of a handle assembly 170 with respect to shaft 120. Handle assembly 170 includes a handle base 172 attached to a proximal end of universal joint 160. A proximal end 174 of handle base 172 includes an axially extending insert (not shown). The insert includes a female faceted connection, similar to a socket. In an exemplary embodiment, the faceted connection includes 12 16 facets.

A handle grip 176 includes a male insert (not shown) for removable insertion into the female faceted connection. The male insert includes a faceted end for engagement into the female faceted connection. In an exemplary embodiment, the faceted end includes 8 facets so that the faceted end can be inserted into the faceted connection in different relative locations to adjust handle grip 176 as desired. The ability to rotate handle grip 176 relative to handle base 172 allows the patient to progress from a lesser torque to a higher torque through exercise. While 16 facets on the faceted connection and 8 facets on the faceted end are desired to allow for rotation of handle grip 176 relative to handle base 172 in 45 degree increments, those skilled in the art will recognize that the number of facets on the faceted connection is a whole number multiple of the number of facets on the faceted end.

Handle grip 176 includes a contoured exterior 178 that includes finger grips to provide for a secure grip.

Device 100 can be used to exercise hand, wrist, and forearm muscles in several different forms. To exercise a right hand inward, toward the body, the patient wraps flexible member 132 around shaft 120 to the position shown in FIG. 2. In this position, a clockwise rotation of shaft 120 looking from the proximal to the distal direction wraps flexible member 132 around shaft 120, pulling helical spring assembly 144 upward. This movement extends helical spring assembly 144 and requires the patient to exert rotational force at the wrist, which is translated into linear force as flexible member 132 wraps around shaft 120. The patient then grips contoured exterior 178 of handle grip 176 and rotates his/her wrist in the inward direction.

Figure 4A:
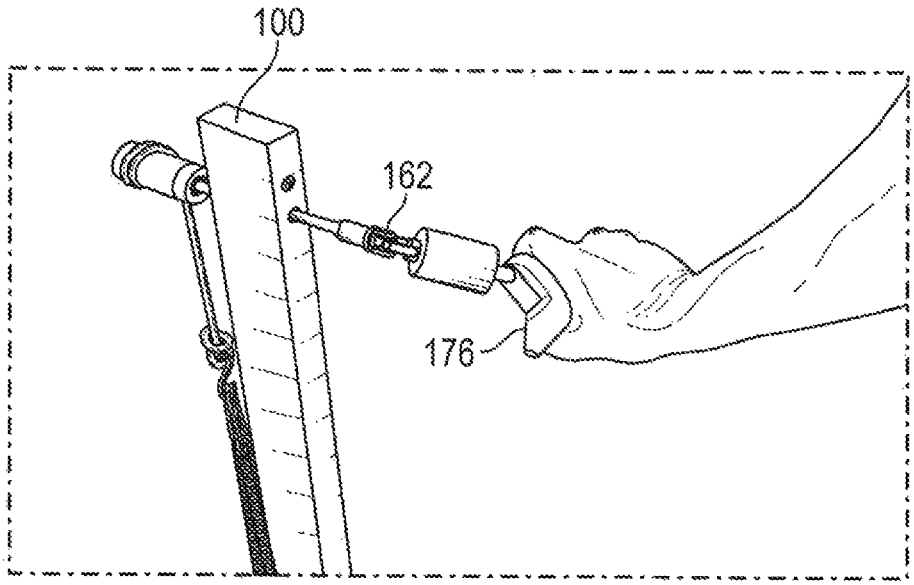
FIG. 4A is a perspective view showing the use of the device shown in FIG. 1 in an extension/pronation direction.
Figure 4B:
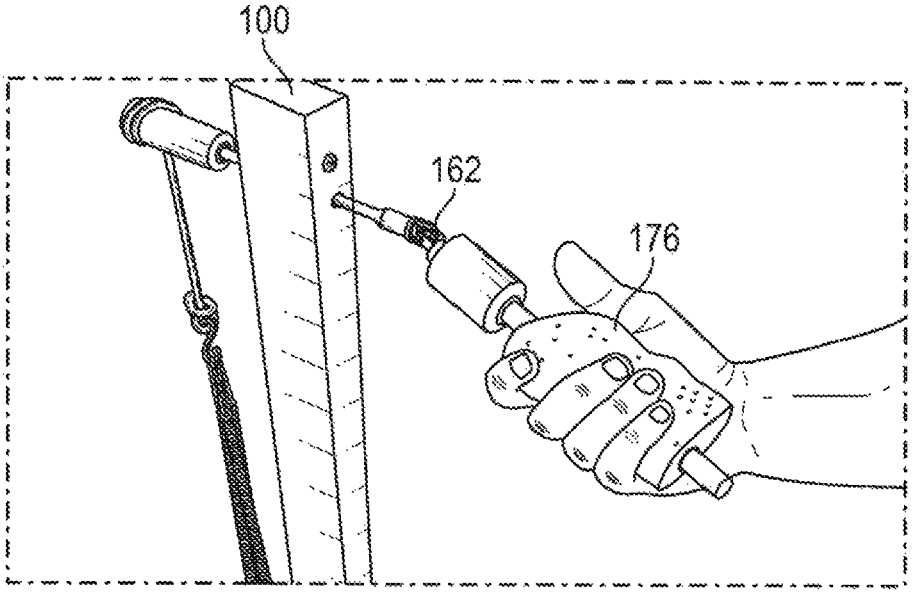
FIG. 4B is a perspective view showing the use of the device shown in FIG. 1 in a flexion/supination direction.

If the patient desires to increase the amount of force required to rotate shaft 120 and extend helical spring assembly 144, the patient slides shaft distally until collar extension 152 is away from collar stop 154. The patient then rotates shaft 120 clockwise (looking from the proximal to the distal direction) a desired rotational amount, and then slides shaft 120 proximally, until collar extension 152 engages support post 104 and shaft 120 can no longer be proximally translated. The additional rotation stretches helical spring assembly 144, requiring additional force to be imparted to helical spring assembly 144 for additional elongation of helical spring assembly 144. Universal joint 162 allows the patient to flex his/her wrist to increase the amount of resistance imparted to the wrist, as well as to allow for multiple directions of exercise, such as extension/pronation (in a first direction, shown in FIG. 4A) or flexion/supination (in a second, opposite, direction, shown in FIG. 4B), depending on the hand, the direction of rotation of flexible member 132 around shaft 120, and the direction of rotation of the wrist.

Similarly, if the patient desires to decrease the force required to exercise the wrist, the patient rotates shaft 120 counter-clockwise (looking from the proximal to the distal direction) a desired rotational amount, and then slides shaft 120 proximally, until collar extension 152 engages support post 104 and shaft 120 can no longer be proximally translated.

If the patient desires to exercise his/her left wrist in an outward direction away from the body, he/she maintains device 100 in the same configuration and can increase or decrease the amount of force required to rotate shaft 120 as described immediately above.

If, however, the patient desires to exercise the left wrist in the inward direction or the right wrist in the outward direction, the patient release handle grip 176 and translates shaft 120 distally until collar extension 152 is away from collar stop 154. The patient then rotates shaft 120 counter-clockwise looking from the proximal to the distal direction, unwinding flexible member 132 from shaft 120, and then re-winding flexible member 132 onto shaft 120, in the counter-clockwise direction.

The patient then proceeds as described above with respect to exercising the right wrist in the inward direction.

Figure 5:
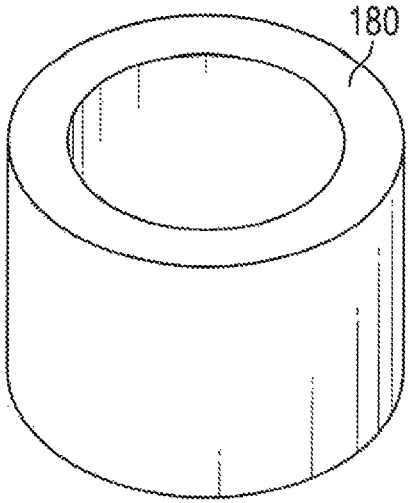
FIG. 5 is a perspective view of a support device used with the device shown in FIG. 1
Figure 6:
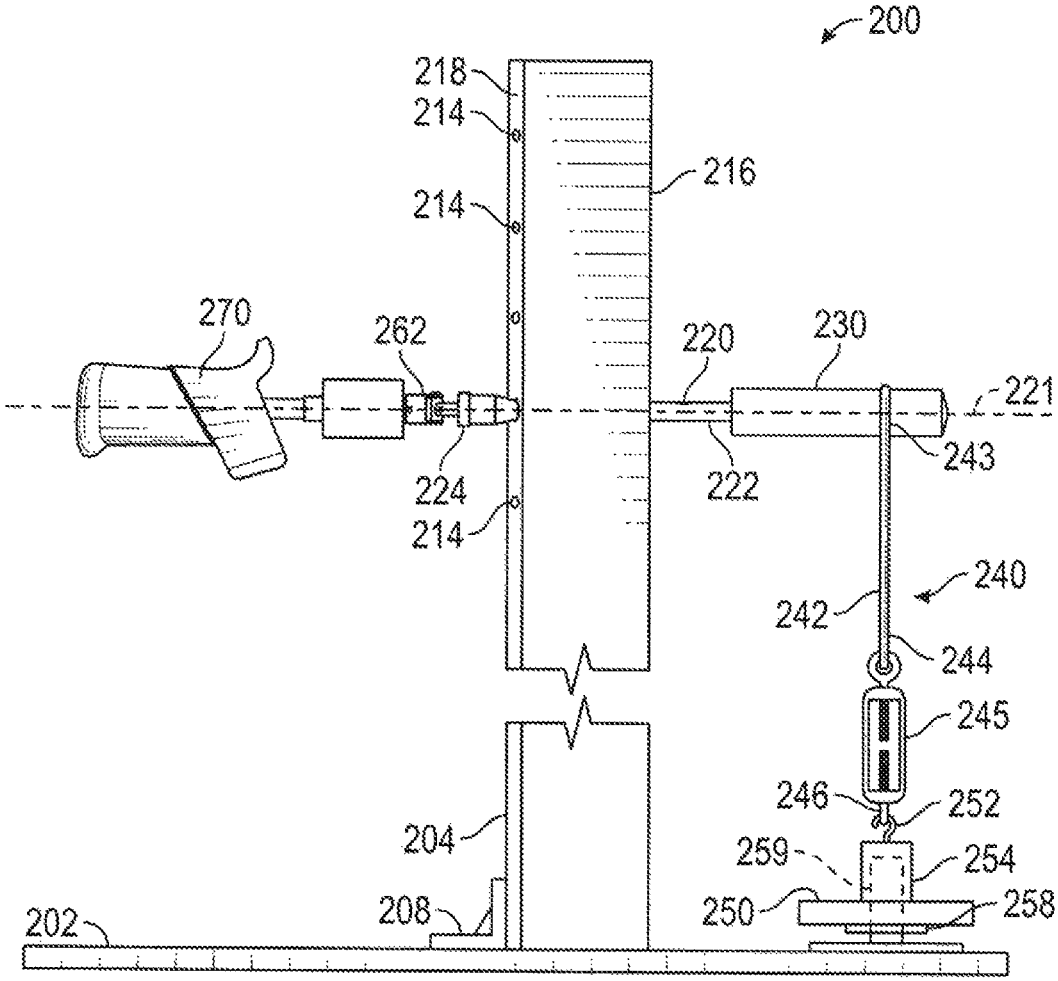
FIG. 6 is a side elevational view of a wrist and forearm exercise and rehabilitation device according to a second exemplary embodiment of the present invention.

Optionally, to ensure that the patient is using the desired muscles and not moving his/her elbow or using his/her upper arm to perform the work, the patient can place a brace 180, shown in FIG. 5, between his/her upper arm and torso, squeezing brace 180 between the upper arm and torso. If the patient is performing the exercise incorrectly and is using his/her upper arm instead of his/her wrist, brace 180 is no longer supported and falls to the floor.

While and exemplary brace 180 is shown as a tubular piece of open cell foam material, those skilled in the art will recognize that other materials and shapes can be used in the alternative.

An alternative embodiment of an exercise device ("device") 200 that can be used for rehabilitating and strengthening muscles in a hand, wrist and forearm is shown in FIGS. 6-10.

Device 200 includes a base 202 on which a patient stands during use of device 200. If the patient is seated, the patient's chair can be placed on base 202 to keep device 200 from moving along the floor while in use. Alternatively, if device 200 is to be permanently fixed in a location, base 202 can be fixedly attached to the floor, such as by bolts or other suitable securing device.

A support post 204 extends upwardly from base 202 at a distal end 206 of base 202. Optionally, support gussets 208 can be provided at a juncture of base 202 and support post 204 to provide both lateral and longitudinal stability to support post 204 with respect to base 202.

Figure 7:
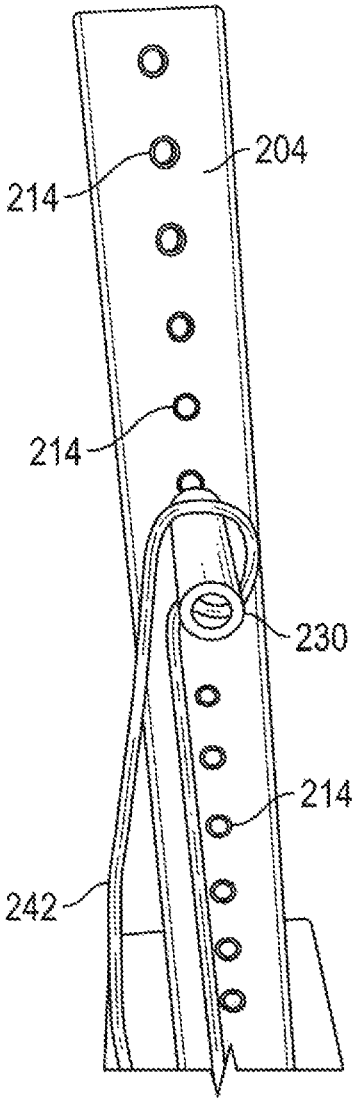
FIG. 7 is a front elevational view of the wrist and forearm exercise and rehabilitation device of FIG. 6.
Figure 8:
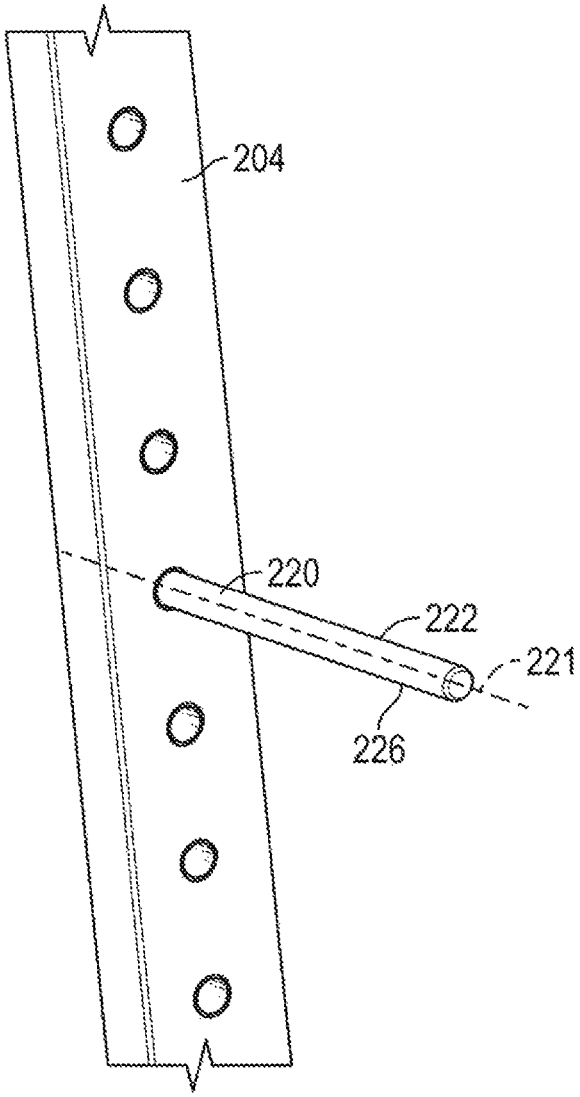
FIG. 8 is a perspective view of the distal end of the wrist and forearm exercise and rehabilitation device of FIG. 6, with the collar removed.

Referring to FIG. 7, support post 204 includes a plurality of slots 214 extending therethrough from a distal side 216 to a proximal side 218. Adjacent slots 214 are vertically separated from each other by a predetermined distance, such as, for example, about four inches, although those skilled in the art will recognize that slots 214 can be vertically separated by different distances.

Each slot 214 has a generally circular cross section and is used to rotatably support a shaft 220 inserted therethrough. Shaft 220 is elongated, with a central longitudinal axis 221 extending therethrough. Shaft 220 also has a circular cross section, smaller than the cross section of slots 214, so that the portion of shaft 220 that is within slot 214 while the patient is exercising can rotate within slot 214. Shaft 220 is axially rotatable and proximally/distally slidable within the selected slot 214. Shaft 220 is inserted into a selected slot 214 based on the patient's height and comfort level with the height of shaft 220 from the floor.

Shaft 220 includes a distal end 222 that extends from distal side 216 of support post 204 and a proximal end 224 that extends from proximal side 218 of support post 204. Distal end 222 includes a keyed surface 226 (shown in FIG. 8) that is slidably insertable into a collar 230. Collar 230 has an internal keyway (not shown) that mates with distal end 222 of shaft 220 so that, when distal end 222 of shaft 220 is inserted into collar 230 and shaft 220 is rotated, collar 230 rotates with shaft 220. Collar 230 is slidably removable from shaft 220, though, so that, when collar 230 is removed from shaft 220, shaft 220 can be slid out of slot 214 and inserted into another slot 214.

Referring back to FIG. 6, a biasing assembly 240 is attached to collar 230. Biasing assembly 240 includes a flexible member 242, such as a rope, a cable, or other suitable elongate flexible member, having a top end 243 connected to collar 230. Flexible member 242 has a lower end 244 that is connected to a turnbuckle 245. Turnbuckle 245 is in turn connected to a lifting eye 246. A biasing member in the form of a weight stack 250 having an upper hook 252 is releasably attachable to lifting eye 246. Upper hook 252 can be inserted through lifting eye 246 so that flexible member 242 vertically supports weight stack 250. Turnbuckle 245 is provided to provide fine adjustment of the height of weight stack 250 to maintain weight stack 250 above base 202 so that weight stack 250 always applies tension to flexible member 242.

Weight stack 250 also includes a hollow central post 254 that centers removable weight plates 256 onto weight stack 250. A lower collar 258 is connected to the bottom end of central post 254 so that weight plates 256 rest on and are lifted by lower collar 258.

A post guide 259 is fixed to base 202, distal of support post 204 and directly under hollow central post 254. Post guide 259 has a smaller outer diameter than the inner diameter of hollow central post 254 so that hollow central post 254 can be inserted over post guide 259 to restrict weight stack 250 from oscillating as weight stack 250 is being lifted up and down as the patient is exercising.

Alternatively, instead of weight stack 250, device 200 can incorporate helical spring assembly 144 from device 100 as described above. Alternatively, other types of means for biasing collar 230 can be provided.

Collar 230 can have a predetermined diameter to relate a rotational angle of movement of collar 230 with a desired amount of biasing exerted on weight stack 250. For example, for a larger diameter shaft, a larger force is applied to collar 230 to rotate shaft 220 a certain number of degrees than the force that needs to be applied to rotate shaft 220 the same amount of degrees with a smaller diameter of collar 230.

Figure 9:
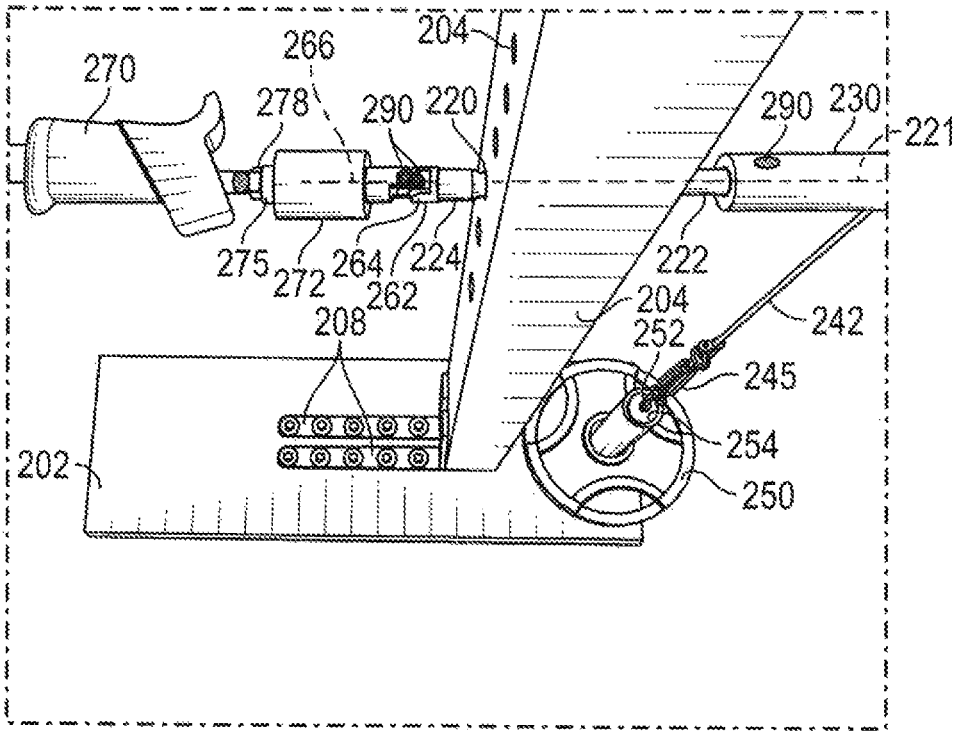
FIG. 9 is a side perspective view of the wrist and forearm exercise and rehabilitation device of FIG. 6 prior to rotating the wrist.
Figure 10:
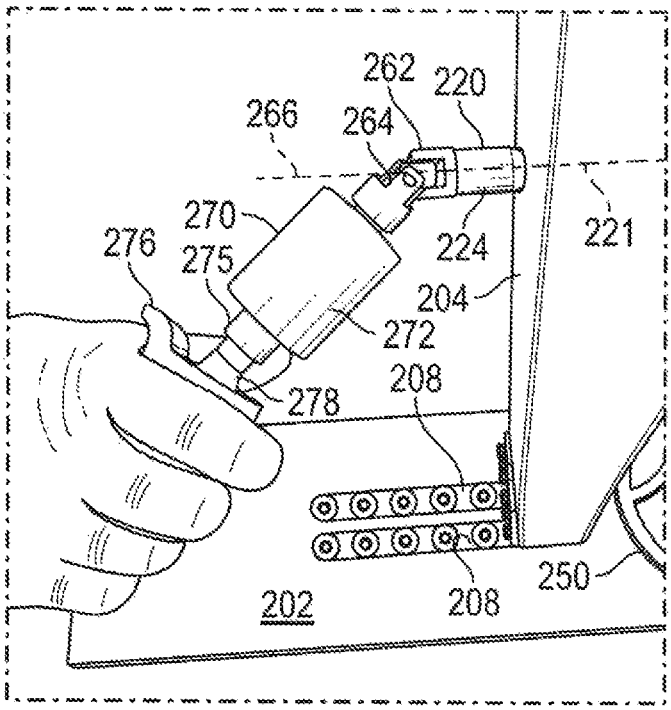
FIG. 10 is a side perspective view of the wrist and forearm exercise and rehabilitation device of FIG. 6 after rotating the wrist.

Referring to FIGS. 9 and 10, proximal end 224 of shaft 220 ends in a universal joint 262. Universal joint 262 allows for infinite rotation of a handle assembly 270 with respect to shaft 220. Referring to FIG. 9, universal joint 262 includes a generally parallelepiped cross shaft 264 having a central longitudinal axis 266.

Handle assembly 270 includes a handle base 272 attached to a proximal end of universal joint 260. A proximal end 274 of handle base 272 includes an axially extending sleeve 275. Sleeve 275 includes a female faceted connection, similar to a socket. In an exemplary embodiment, the faceted connection can include 4-12 facets.

A handle grip 276 includes a male insert 278 for removable insertion into sleeve 275. Handle grip 276 can be a commonly known pistol grip in shape. The male insert 278 includes a faceted end for engagement into the female faceted connection of sleeve 275. In an exemplary embodiment, the faceted end includes 4 facets so that the faceted end can be inserted into the faceted connection in different relative locations to adjust handle grip 276 as desired. The ability to rotate handle grip 276 relative to handle base 272 allows the patient to progress from a lesser torque to a higher torque through exercise. While 8 facets on the faceted connection and 4 facets on the faceted end are desired to allow for rotation of handle grip 276 relative to handle base 172 in 45 degree increments, those skilled in the art will recognize that the number of facets on the faceted connection is a whole number multiple of the number of facets on the faceted end. Handle grip 276 includes a contoured exterior 278 that includes finger grips to provide for a secure grip.

Optionally, as shown in FIG. 9, indicia 290 can be applied to collar 230. Cross shaft 264, sleeve 275, and insert 278 so that all indicia 290 is linearly aligned. In this position, central longitudinal axis 266 of cross shaft 264 extends co-linearly with central longitudinal axis 221 of shaft 220.

Similar to device 100, device 200 can be used to exercise hand, wrist, and forearm muscles in several different forms. To exercise a right hand inward, toward the body, the patient wraps flexible member 242 around shaft 220 to the position shown in FIG. 6. In this position, a clockwise rotation of shaft 220 looking from the proximal to the distal direction wraps flexible member 242 around shaft 220, pulling weight stack 250 upward. This movement requires the patient to exert rotational force at the wrist, which is translated into linear force as flexible member 242 wraps around shaft 220. The patient then grips contoured exterior 278 of handle grip 276 and rotates his/her wrist in the inward direction. As shown in FIG. 10, with handle grip 276 rotated such that handle grip 276 extends away from central longitudinal axis 221 of shaft 220, central longitudinal axis 266 of cross shaft 264 still extends co-linearly with central longitudinal axis 221 of shaft 220.

If the patient desires to change the amount of force required to rotate shaft 220 and lift weight stack 250, the patient (or a technician) removes upper hook 252 from lifting eye 246 and either adds or removes weight plates 256 onto weight stack 250. The patient (or technician) then re-hooks upper hook 252 onto lifting eye 246.

Universal joint 262 allows the patient to flex his/her wrist to increase the amount of resistance imparted to the wrist, as well as to allow for multiple directions of exercise, such as extension/pronation or flexion/supination, depending on the hand, the direction of rotation of flexible member 242 around shaft 220, and the direction of rotation of the wrist.

If the patient desires to exercise his/her left wrist in an outward direction away from the body, he/she maintains device 200 in the same configuration and can increase or decrease the amount of force required to rotate shaft 120 as described immediately above.

If, however, the patient desires to exercise the left wrist in the inward direction or the right wrist in the outward direction, the patient release handle grip 276 and rotates shaft 220 counter-clockwise looking from the proximal to the distal direction, unwinding flexible member 242 from shaft 220, and then re-winding flexible member 242 onto shaft 220, in the counter-clockwise direction.

The patient then proceeds as described above with respect to exercising the right wrist in the inward direction.

Optionally, to ensure that the patient is using the desired muscles and not moving his/her elbow or using his/her upper arm to perform the work, the patient can place brace 180, shown in FIG. 5, between his/her upper arm and torso, squeezing brace 180 between the upper arm and torso. If the patient is performing the exercise incorrectly and is using his/her upper arm instead of his/her wrist, brace 180 is no longer supported and falls to the floor.

While and exemplary brace 180 is shown as a tubular piece of open cell foam material, those skilled in the art will recognize that other materials and shapes can be used in the alternative.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A wrist and forearm exercise and rehabilitation device comprising a base;

a post extending vertically from the base, the post having a plurality of slots formed therein;

a shaft rotatably inserted into a selected one of the slots, the shaft having a proximal end and a distal end;

a biasing member having a first end attached to the distal end of the shaft, such that rotation of the shaft exerts a force on the biasing member;

a handle attached to the proximal end of the shaft; and a universal joint located between the handle and the shaft, the universal joint providing rotation of the handle with respect to the shaft; and a post guide extending upwardly from the base and wherein the biasing member further comprises a hollow central post supporting the weight, the post guide extending into the central post, wherein the biasing member comprises a flexible member connected to the shaft and a weight connected to the flexible member.

2. The wrist and forearm exercise and rehabilitation device according to claim 1, further comprising a turnbuckle located between the flexible member and the weight.

3. The wrist and forearm exercise and rehabilitation device according to claim 1, wherein the weight is releasably connected to the flexible member.

4. The wrist and forearm exercise and rehabilitation device according to claim 1, further comprising a collar releasably connected to the distal end of the shaft, the collar connected to the biasing member.

5. The wrist and forearm exercise and rehabilitation device according to claim 1, wherein the handle is releasably connected to the universal joint.

6. The wrist and forearm exercise and rehabilitation device according to claim 5, wherein the handle is selectively rotatably connected to the universal joint.

7. A wrist and forearm exercise and rehabilitation device comprising:

a planar base configured to allow a user to stand on;

a post extending vertically from the base;

a shaft rotatably extending through the post, the shaft having a proximal end and a distal end, the distal end being unsupported, and a shaft central longitudinal axis extending therethrough;

a single handle grip connected to the proximal end of the shaft;

a universal joint located between the single handle grip and the shaft, the universal joint having a cross shaft, the cross shaft having a cross shaft central longitudinal axis extending therethrough; and a biasing member having a first end attached to the distal end of the shaft, such that rotation of the shaft exerts a force on the biasing member.

8. The wrist and forearm exercise and rehabilitation device according to claim 7, wherein the shaft is axially translatable relative to the post.

9. The wrist and forearm exercise and rehabilitation device according to claim 8, further comprising a collar extension extending radially outwardly from the shaft such that, when the shaft is axially translated in a proximal direction, the collar extension is engaged with the post and, wherein, when the shaft is axially translated in a distal direction, the collar extension is not engaged with the post.

10. A method of performing a wrist exercise comprising the steps of:

(a) providing the device according to claim 7;

(b) gripping the single handle grip with one hand; and (c) alternatively rotating the shaft in one of a clockwise direction and a counter-clockwise direction.

11. The method according to claim 10, wherein, prior to step (c), the shaft central longitudinal axis and the cross shaft central longitudinal axis are co-linear and, after step (c), aligning the shaft central longitudinal axis and the cross shaft central longitudinal axis co-linearly.

12. The method according to claim 10, wherein step (c) comprises moving the biasing member.

* * * * *